US005584405A

United States Patent [19]

Tunzi

[11] Patent Number: 5,584,405

[45] Date of Patent: Dec. 17, 1996

[54] ADJUSTABLE SHELF FOR A REFRIGERATOR

[75] Inventor: Todd J. Tunzi, Galesburg, Ill.

[73] Assignee: Maytag Corporation, Newton, Iowa

[21] Appl. No.: 373,383

[22] Filed: Jan. 17, 1995

[51] Int. Cl.[6] ..... A47F 5/00

[52] U.S. Cl. ..... 211/153; 211/90; 211/175; 211/181; 108/137; 108/152

[58] Field of Search ..... 211/90, 106, 153, 211/134, 175, 181, 186; 108/181, 152, 137, 143

[56] References Cited

U.S. PATENT DOCUMENTS

| | | | |
|---|---|---|---|
| 573,835 | 12/1896 | Taylor . | |
| 2,008,091 | 7/1935 | Betts | 108/137 |
| 2,091,607 | 8/1937 | Nave | 211/153 |
| 2,299,885 | 4/1941 | Ellsworth et al. | 211/153 |
| 3,998,170 | 12/1976 | Gordon | 211/153 X |
| 4,178,844 | 12/1979 | Ward et al. | 99/449 |
| 4,267,931 | 5/1981 | Belotta | 211/153 |
| 4,783,035 | 11/1988 | Remmers | 211/134 X |
| 5,170,897 | 3/1992 | Wentworth | 211/181 |
| 5,450,971 | 9/1995 | Boron et al. | 211/153 X |

*Primary Examiner*—Robert W. Gibson, Jr.
*Attorney, Agent, or Firm*—Mark W. Borgman

[57] ABSTRACT

An adjustable shelf for a refrigerator compartment has two parts, a platform and a support member and provides adjustment of both the length and the height of the shelf. The platform is attached at a first end to a compartment wall at one of two heights. The support member is slidably attached to the second end of the platform to allow adjustment of the length of the shelf. The support member has two legs with different lengths. The selection of the leg to support the platform in cooperation with selection of the corresponding attachment height at the first end of the platform determines the height of the shelf.

3 Claims, 4 Drawing Sheets

ADJUSTABLE SHELF FOR A REFRIGERATOR

BACKGROUND OF THE INVENTION

The present invention relates to an adjustable shelf for a refrigerator. The adjustable shelf is particularly useful in the freezer compartment, but can also be used in the fresh food compartment.

Previous shelving systems for refrigerators have allowed only limited flexibility in the arrangement of shelves. Users of refrigerators often wish to store items that exceed the maximum height allowed by the shelves. In such a case, users must either remove a shelf or transfer the item to a package that will fit within the confines of the space defined by the existing shelf. Some refrigerators in the past have been provided with shelves that can be adjusted in length to provide a gap between the end of the shelf and a wall of the compartment; this gap provides a taller space within the compartment. It is also known to provide alternative attachment points for a shelf at varying heights to allow some vertical adjustment of the shelf. It has heretofore not been possible, however, to provide a shelf that is adjustable both vertically and horizontally, providing the consumer with maximum flexibility.

Therefore, it is an object of the present invention to provide a shelf for a refrigerator that can be adjusted both vertically and horizontally.

A further object of the present invention is to provide an adjustable shelf that is easy to adjust and rearrange in configuration.

SUMMARY OF THE INVENTION

The foregoing objects are achieved by an adjustable shelf for a refrigerator compartment comprising a platform attachable at a first end to the compartment wall at a first and a second height. An "L" shaped support member having one leg longer than the other is attachable to the second end of the platform with one leg of the support member extending beyond the platform to provide variation in the length of the shelf and the other leg of the support member extending downward to provide support for the second end of the platform. The attachment of the shelf at the first height at the first end and to the first leg of the support member at the second end provides a first height of the platform and attachment of the shelf at the second height at the first end and attachment to the second leg of the support member at the second end provides a second height of the platform.

DETAILED DESCRIPTION OF THE PREFERRED EMBODIMENT

Figure 1:
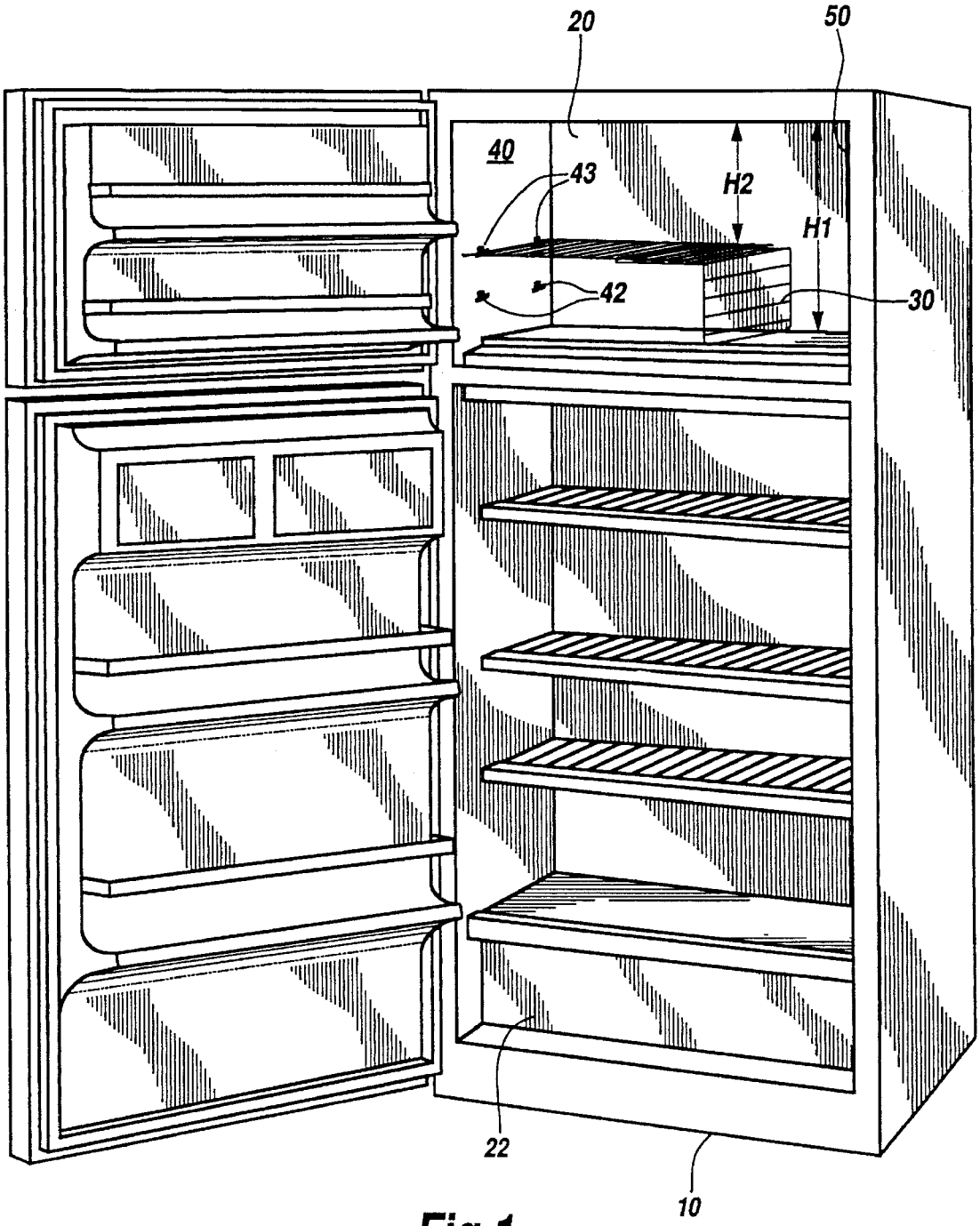
FIG. 1 is a perspective view of a refrigerator incorporating the present invention.

Referring to FIGS. 1–4, a refrigerator 10 is shown including a freezer compartment 20 and a refrigerator compartment 22. An adjustable shelf 30 in accordance with the current invention is shown in the freezer 20. The freezer 20 further comprises a first wall 40 and a second wall 50.

Figure 2:
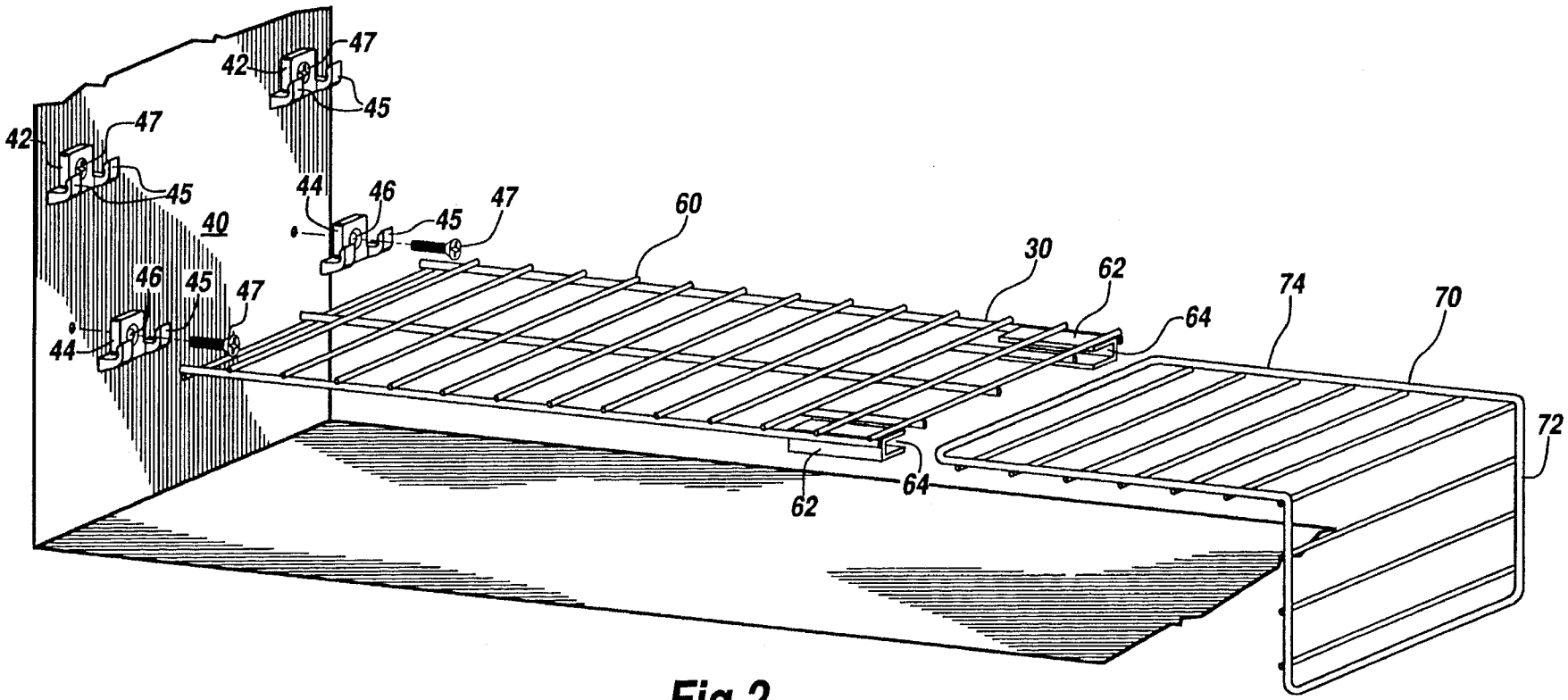
FIG. 2 is an exploded view of an adjustable rack.
Figure 3:
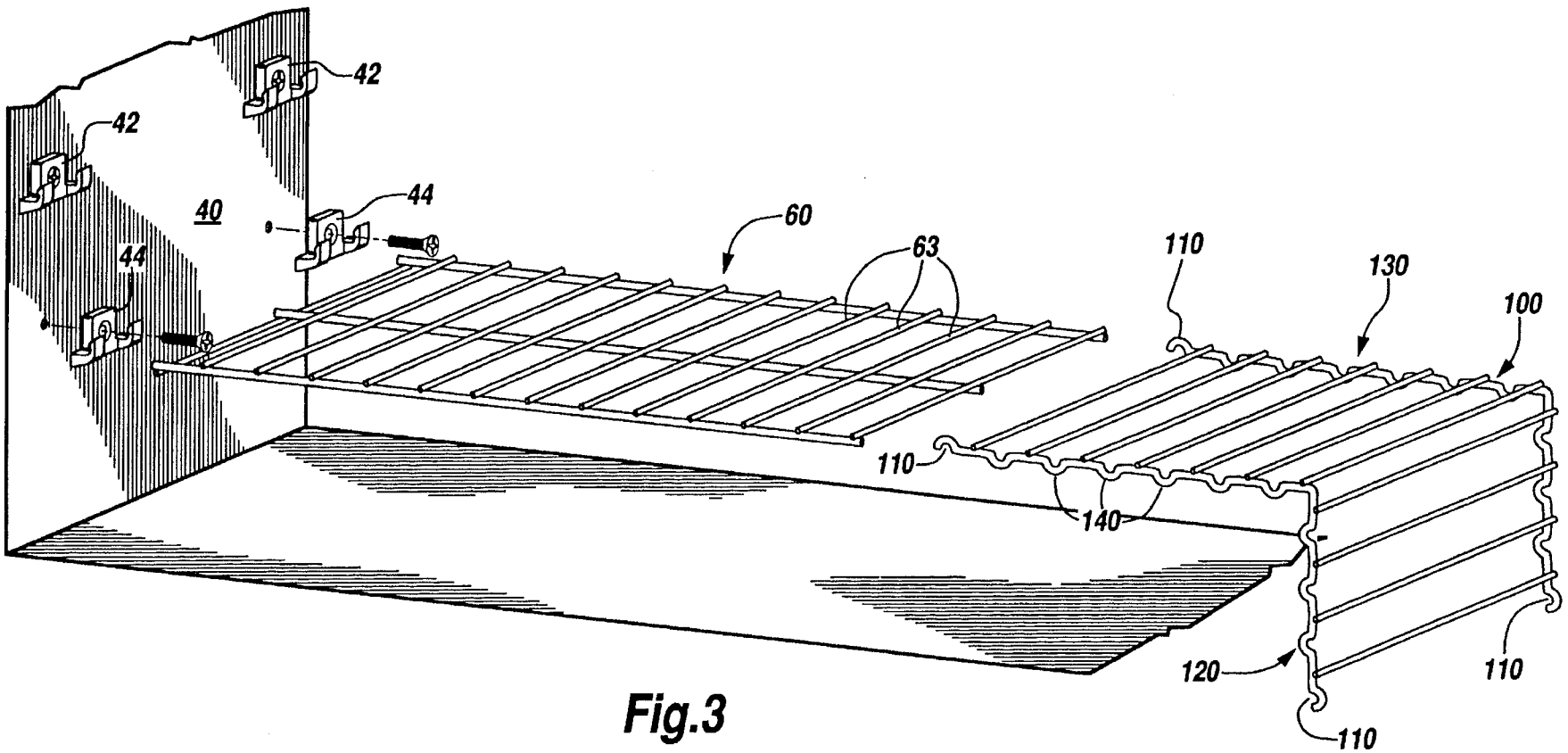
FIG. 3 is an exploded view of an alternative adjustable rack.

One of the walls 40 includes at least a first pair of receptacles 42 and a second pair of receptacles 43. The pairs of receptacles 42,43 are spaced apart on the wall at two different heights. A pair of holding brackets 44 each having a hook 45 on one side and a centrally located screw hole 46 as best shown in FIG. 2 is secured to one of the receptacles of a pair 42,43 via a threaded screw 47. When attached, the hooks 45 are in substantial horizontal alignment in the freezer compartment 20. The holding brackets 44 could be attached wall 40 in a number of other ways including glue, tabs or other suitable means.

The adjustable shelf 30 includes a platform 60 and an "L" shaped support member 70. Both the platform 60 and support member 70 are shown constructed of coated wire although other materials such as molded plastic or other suitable material may be used.

At a first end, the platform 60 includes a wire 68 across the under side. This wire 68 is formed to provide a snug fit with the hooks 45 and the holding brackets 44 mounted to the freezer first wall 40. The hooks 45, in cooperation with the wire 68 thus provide support for one end of the platform 60. A variety of alternative supporting mechanisms may be used including flanges, pegs or other suitable means in place of the described holding brackets 44. On the under side of a second end, the platform 60 includes a pair of flanges 62. The flanges 62 are on opposite sides of the platform 60 and face each other. A channel 64 is defined by the flanges 62.

The support member 70 is substantially "L" shaped with a first leg 72 and a second leg 74. The first leg 72 is shorter than the second leg 74. The support member 70 is formed to provide a snug fit when slidably inserted into the channel 64 of the platform 60.

In a first arrangement, the holding brackets 44 are inserted into the higher of the pairs of receptacles 43 and the first leg 72 of the support member 70 is inserted into the channel 64. The higher pair of receptacles 43 are set such that upon mating the wire 68 into the hooks 45 and upon insertion of the first leg 72 into the channel 64, the platform is substantially level within the freezer compartment 20. The first leg 72 may be selectively slid into or out of the channel 64 to provide horizontal adjustment of the shelf 30. In this way, the user may adjust the shelf either to extend across the entire width of the freezer compartment 20 at a height H2 or the user may slide the first leg 72 further into the channel 64 to provide a portion of the freezer compartment 20 with a storage height H1 equal to the total height of the freezer compartment 20. This is useful for example, when the user wishes to store tall items.

In a second arrangement, the second leg 74 of the support member 70 is inserted into the channel 64. The holding brackets 44 are mounted in the lower pair of receptacles with the wire 68 inserted in the hooks 45. As with the first leg 72 above, the second leg 74 may be slidably inserted into the platform 64 to provide horizontal adjustment of the shelf 30. However, because the first leg 72 is shorter than the second leg 74, the resulting height of the shelf 30 is shorter than in the first arrangement. Thus, the user may adjust the height of the shelf 30 by selecting which leg of the support member 70 is inserted into the channel 64 along with selecting the corresponding receptacles 42,43 for the holding brackets 44.

Figure 4:
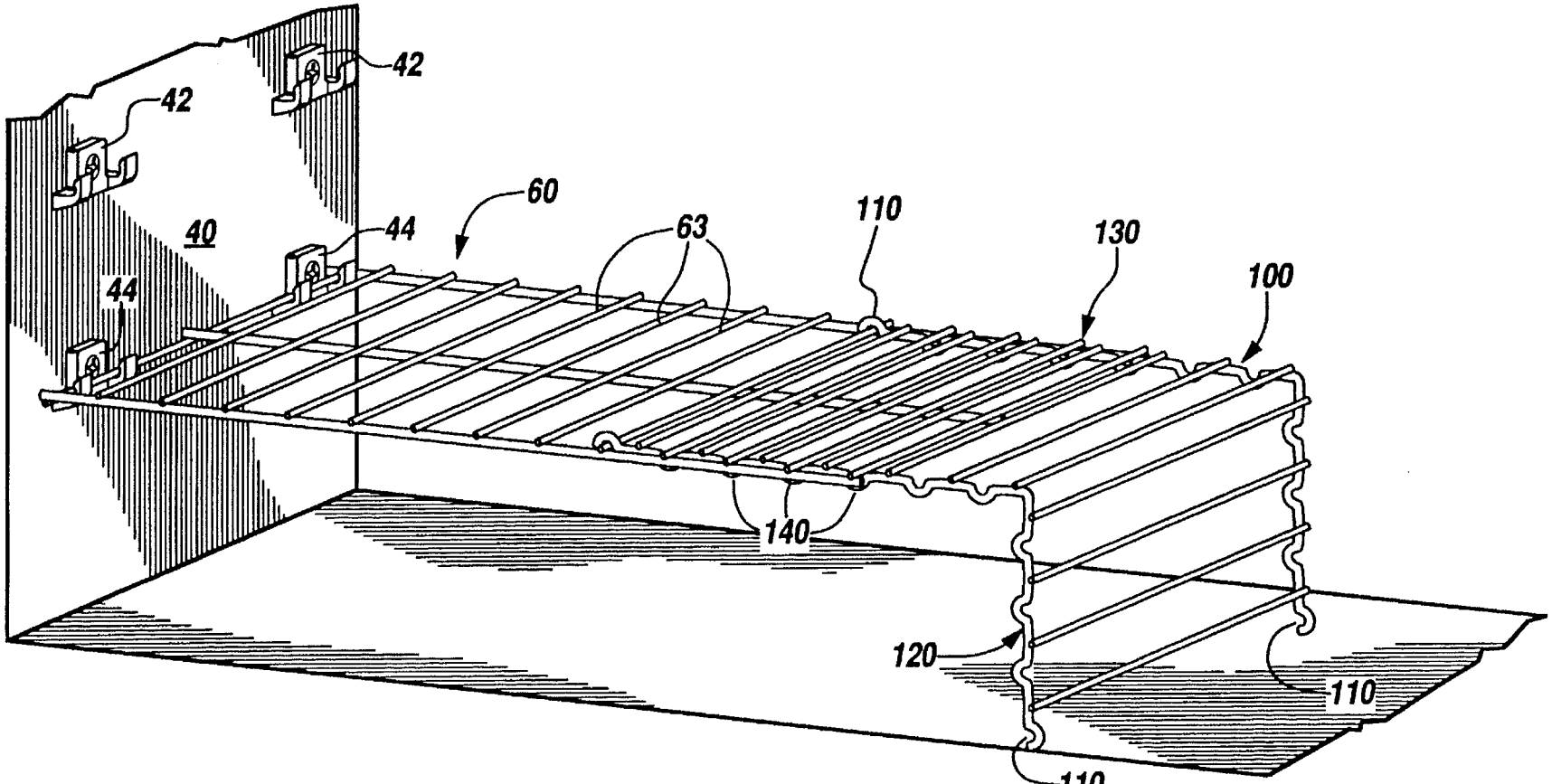
FIG. 4 is a perspective view of the alternative adjustable rack.

An alternative embodiment is shown in FIGS. 4 and 5. In this embodiment, the platform 60 attaches to the wall 40 by the same holding brackets 44 as previously discussed in detail. The end of first leg 120 and the second leg 130 of the support member 100, include a finger 110 formed to fit around any of the wires 63 on the platform 60. The first leg 120 and the second leg 130 further include indentations 140 spaced along the length of the legs at points corresponding with the distance between the wires 63 on the platform 60.

While gently lifting second end of the platform 60, the finger 110 of a selected leg can be placed around the top of a wire 63. The platform 60 and the support member 100 can then be lowered back into a horizontal position with the finger 110 cooperating with the indentations 140 to provide support for the platform 60. By lifting the platform 60 and selectively placing the finger 110 around a different wire 63, the width of the system may be incrementally adjusted.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. An adjustable shelf for an appliance comprising:

a platform selectably attachable at a first end to a wall of the appliance at a first height and a second height;

an "L" shaped support member having a first leg and a second leg, the legs being of different lengths and selectably attachable to the second end of the platform to selectably extend a plurality of lengths beyond the second end of the platform;

and wherein when the first leg of the support member is attached to the second end of the platform the second leg of the support member supports the platform at the first height and when the second leg of the support member is attached to the second end of the platform the first leg of the support member supports the platform at the second height.

2. The adjustable shelf of claim 1 wherein:

the first and second legs of the support member are slidably attachable to the platform to adjustably extend beyond the second end of the platform.

3. The adjustable shelf of claim 2 further comprising:

a first and second flange extending below the platform on each side of the second end of the platform to define channels for slidably receiving one of the first and second legs of the support member.

* * * * *